US006325083B1

(12) United States Patent
Wörter

(10) Patent No.: US 6,325,083 B1
(45) Date of Patent: Dec. 4, 2001

(54) RINSING DEVICE FOR A DISH WASHER

(75) Inventor: Markus Wörter, Hohberg (DE)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/354,212

(22) Filed: Jul. 15, 1999

(30) Foreign Application Priority Data

Jul. 22, 1998 (DE) ..... 198 32 982

(51) Int. Cl.[7] ..... B08B 3/02
(52) U.S. Cl. ..... 134/180; 134/176; 134/179
(58) Field of Search ..... 134/176, 179, 134/180, 181, 57 D, 56 D, 58 D, 200

(56) References Cited

U.S. PATENT DOCUMENTS

| | | | |
|---|---|---|---|
| 1,675,192 | * | 6/1928 | Murdoch . |
| 2,748,944 | * | 6/1956 | Kalinske . |
| 3,058,479 | * | 10/1962 | Fay et al. . |
| 3,496,949 | * | 2/1970 | Mercer . |
| 3,771,725 | * | 11/1973 | Jenkins et al. . |
| 3,797,509 | * | 3/1974 | Fukuzawa et al. . |
| 3,941,139 | * | 3/1976 | Spiegel . |
| 4,509,687 | | 4/1985 | Cushing . |
| 4,827,563 | * | 5/1989 | Gordon . |
| 5,267,582 | | 12/1993 | Purtilo . |
| 5,464,482 | * | 11/1995 | Michael et al. . |
| 5,477,874 | * | 12/1995 | Yura et al. . |
| 5,655,556 | * | 8/1997 | Guerra et al. . |
| 5,842,492 | * | 12/1998 | Lee . |
| 5,944,037 | * | 8/1999 | Sinyong et al. . |

FOREIGN PATENT DOCUMENTS

| | | | | |
|---|---|---|---|---|
| 70 24 995 | * | 3/1971 | (DE) . | |
| 1 628 518 | * | 4/1971 | (DE) . | |
| 2100590 | * | 8/1971 | (DE) | 134/179 |
| 3813510 A1 | | 4/1988 | (DE) . | |
| 550511 | * | 1/1943 | (GB) | 134/179 |
| 1286820 | * | 1/1972 | (GB) | 134/179 |
| 2-99026 | * | 4/1990 | (JP) . | |
| 5-130964 | * | 5/1993 | (JP) | 134/176 |
| 6-233736 | * | 8/1994 | (JP) | 134/179 |
| 06315450 | * | 11/1994 | (JP) . | |

* cited by examiner

*Primary Examiner*—Frankie L. Stinson
(74) *Attorney, Agent, or Firm*—Thompson Hine LLP

(57) ABSTRACT

A washing device or rinsing device for a dish washer comprises a washing arm or rinsing arm (14) and an axis which rotatably supports the washing arm or rinsing arm (14). The washing arm or rinsing arm (14) comprises a first chamber (36) and a second chamber (33) separate from the first chamber.

The first chamber (36) and the second chamber (38) each have at least one inlet aperture (40, 50) and at least one outlet aperture **(48, 48*a*, 22) for washing liquid or rinsing liquid. The at least one outlet aperture (22) of the second chamber (38) is designed as a corner spray nozzle and liquid can be applied thereto only in defined rotary positions of the washing arm or rinsing arm (14) on the axis (16)**.

6 Claims, 3 Drawing Sheets

RINSING DEVICE FOR A DISH WASHER

TECHNICAL FIELD

The invention relates to a washing- or rinsing device for a dish washer.

PRIOR ART

Dish washers, particularly for the domestic sphere, comprise a cuboid rinsing container whose front side is provided with a loading door in order to gain access to the baskets arranged on rails within the dish washer. At least one rinsing arm rotatable around an axis is arranged within the dish washer.

To enable the rinsing arm to rotate within the dish washer, this arm must be designed so as to pass over a circular surface during its movements on a horizontal plane; this circular surface is located within the dish washer housing that is rectangular or quadratic in horizontal section.

Since the baskets are adapted to the dish washer's inner geometry and can be completely loaded with dirty dishes, care must be taken that rinsing liquid or washing liquid is also sufficiently applied to the dishes arranged in the corner area of the baskets so as to ensure that they will be cleaned. As a rule, this is achieved in the prior art in that the rinsing arms comprise nozzles arranged radially outwards and issuing the rinsing liquid or washing liquid at an angle in a radially outward manner. This design nevertheless suffers from the drawback that the jets of rinsing liquid or washing liquid directed against the side of the dish washer wall drain off unused and the total quantity of water needed to clean the dishes is increased.

European patent application 0 559 466 A1 relates to the problem of insufficient application of washing liquid to the corner regions of a dish washer. This problem is solved by four special-purpose rinsing arms arranged such as to apply liquid to specific corner areas of the dish washer more intensively. These four auxiliary rinsing arms each have just a single inner hollow chamber and increase the total water consumption because a large part of the liquid emerging from these auxiliary rinsing arms is aimed directly against the dish washer's inner walls.

German utility model 297 18 777 U1 also relates to the problem of inadequate application of washing liquid to the corners of a dish washer. A main rinsing arm and an auxiliary rinsing arm rotatably attached to the main rinsing arm are used, whereby the auxiliary rinsing arm in each case passes along the wall of the dish washer and is also able to reach the corner areas due to the influence of centrifugal force. The overall water consumption entailed by this proposed solution is still very high because, depending on the dish washer's geometry, the auxiliary rinsing arm passes closely along the inner wall, thus issuing a large quantity of washing liquid in an area in which this liquid cannot be used.

DESCRIPTION OF THE INVENTION

The invention is based upon the object of proposing a washing device or rinsing device for a dish washer in which the application of liquid to the corner areas is improved and yet the total water consumption can be kept low.

This object is solved by means of a washing device or rinsing device for a dish washer comprising the features of claim 1, claim 5 or claim 9.

The invention is based upon the idea that the washing arm or rinsing arm rotatably supported on an axis comprises two separate chambers, each chamber having at least one inlet aperture and at least one outlet aperture for washing liquid or rinsing liquid. By designing the at least one outlet aperture as a corner spray nozzle in one of the chambers and by being able to apply washing liquid or rinsing liquid thereto only in defined rotary positions of the washing arm or rinsing arm, an additional jet of washing liquid or rinsing liquid can be systematically applied to the corner area of the dish washer without appreciably increasing water consumption.

The generally used terms "rinsing arm" and "rinsing liquid" also comprise alternatively "washing arm" and "washing liquid".

A corner spray nozzle is defined below as a nozzle whose geometry is designed such that washing liquid can be applied to the dishes arranged in the corner region of a basket.

Preferred embodiments are characterized by the dependent claims.

According to a preferred embodiment, the axis thus comprises a single flow space for rinsing liquid. This has the advantage that the axis can be designed in a simple and inexpensive manner; above all, however, an existing dishwasher rinsing device can be easily retrofitted by using the rinsing arm described here.

The rinsing arm preferably comprises a hub that can be attached on the axis and which supports the rinsing arm; the axis has four bores which are in communication with the flow space. The hub also has four bores that are in flow communication with the second chamber of the rinsing arm and, in defined rotary positions, with the four bores in the axis. This ability to apply liquid to the corner spray nozzles systematically is characterized by a very simple axis design. This also allows existing dish washers to be retrofitted. The pressure build-up of the rinsing liquid in the second chamber of the rinsing arm and the flow through the corner spray nozzles in defined angular regions of the rinsing-arm rotation can also be systematically accomplished by the arrangement of the four bores in the axis.

According to a preferred embodiment, the hub accommodates other bores which are in flow communication with the first chamber and, irrespective of the hub's rotary position relative to the axis, with the flow space of the axis. This measure, which can be implemented in technical terms for example by forming an annular groove on the outer periphery of the axis, or an annular groove on the inner periphery of the hub, ensures that during the rinsing arm's rotary movement, washing liquid is evenly applied to the rinsing-arm outlet apertures which are in communication with the first chamber, whereas during the rinsing arm's rotation, liquid flows through the corner spray nozzles only in those areas in which it is necessary to apply liquid systematically to the corner areas.

According to a preferred embodiment, those outlet apertures of the first chamber of the rinsing arm which are furthest away from the hub are designed such as to issue the washing liquid at an angle in a radially inward manner. This measure ensures that the issued washing liquid is not directed against the walls of the dish washer, thus remaining unused. By interacting with the special-purpose corner spray nozzles, the use of the applied rinsing liquid can be optimized in terms of the dish washer's rinsing function.

SHORT DESCRIPTION OF THE DRAWINGS

The invention will now be described purely by way of example on the basis of the attached drawings in which FIG. 1 shows a diagrammatically illustrated horizontal section through a dish washer using the rinsing device according to the invention;

WAYS OF IMPLEMENTING THE INVENTION

Figure 1:
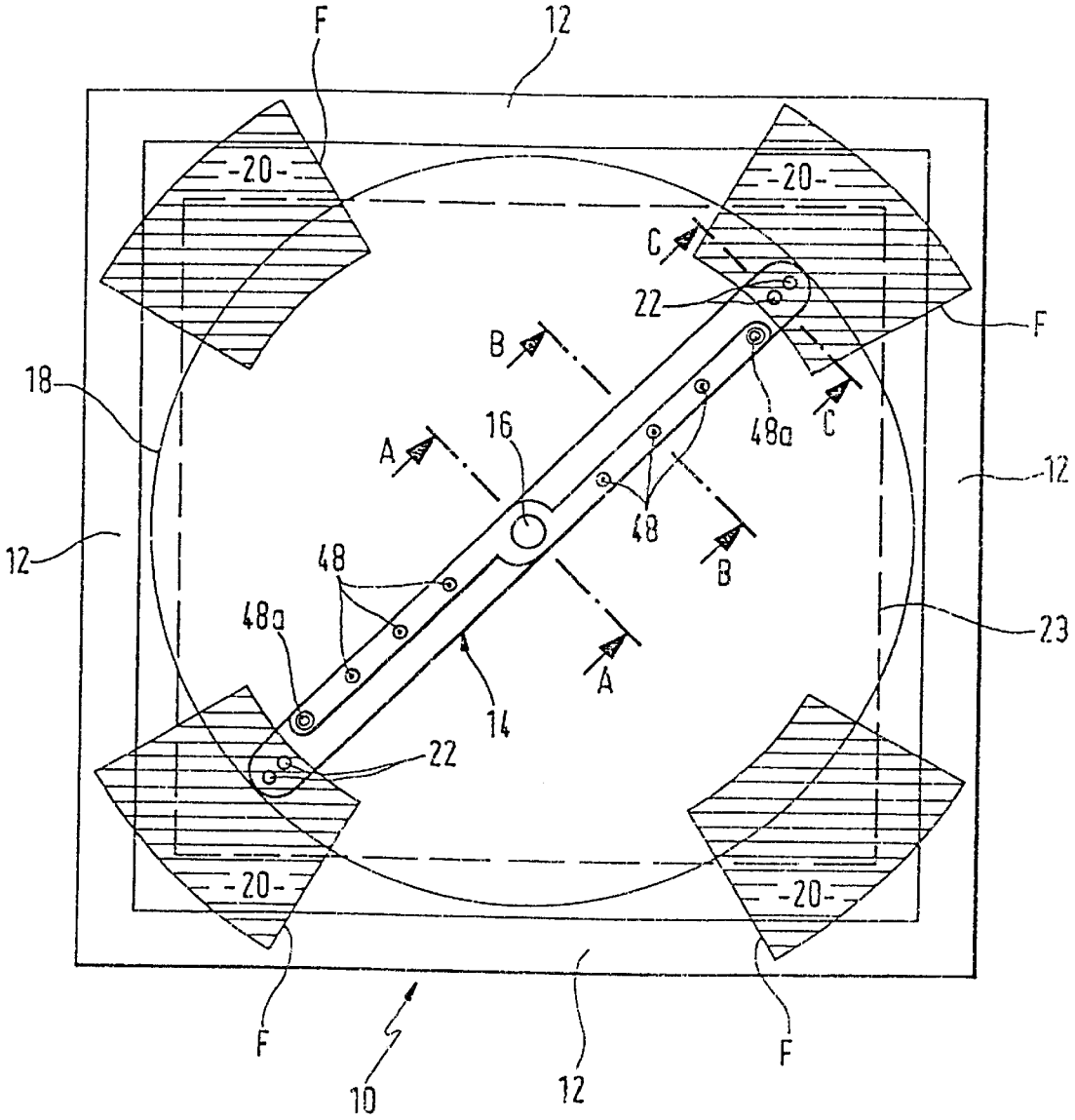

FIG. 1 diagrammatically illustrates a horizontal section through a dish washer generally designated by reference number 10. The dish washer normally has a door pivotable around a horizontal axis, but not shown in the present case. In its closed state, the interior of the dish washer is delimited by four side walls 12 which in the present case have the same dimensions so that the interior of the dish washer 10 has a quadratic cross section in terms of its horizontal section.

FIG. 1 also diagrammatically illustrates the basket 23 for dishes; this basket is indicated by broken lines and is usually movably held along rails located on the side walls. The basket 23, which is adapted to the cross section of the dish washer's interior, has an essentially quadratic shape in the direction of view according to FIG. 1.

FIG. 1 depicts a rinsing device composed of a rinsing arm 14 and an axis 16 on which the rinsing arm is rotatably held. In relation to its length, the rinsing arm 14 is designed such as to be able to pass along the side walls 12 during its rotary movement in the interior of the dish washer, without its making contact with these walls. To illustrate the circular surface covered by the rinsing arm 14 during its rotary movement, the corresponding circumferential circle 18 is depicted in FIG. 1.

As is evident from the illustration in FIG. 1, the rinsing arm 14 does indeed pass closely along the side walls 12 in the middle of their lateral extension, but a relatively large region 20 that is not reached by the rinsing arm 14 remains in the corner area of the dish washer each tire.

The rinsing arm 14 comprises corner spray nozzles 22 which are especially designed to the extent of achieving an application of liquid to those corner regions 20 not reached by the rinsing arm. For this purpose, nozzles 22 which issue washing liquid essentially upwards or downwards, depending on the geometry of the dish washer, are arranged close to that end of the rinsing arm which is on the outside in the radial direction. The corner spray nozzles 22 are also shaped such that when the rinsing liquid is issued upwards or downwards, a directional component is produced in a radially outward manner.

The corner spray nozzles are not in operation during the entire rotation of tho rinsing arm 14, but only when the rinsing arm is located in a region in which it is aligned in one of the diagonals to the rectangular cross section of the dish washer. The systematic operation of the corner spray nozzles 22 in this area creates a surface F which FIG. 1 diagrammatically illustrates in each of the corner regions and which represents the discharge of rinsing liquid emerging out of the corner spray nozzles 22 in the event that the emergent liquid is not restricted by the presence of the side walls 22. In the example diagrammatically illustrated in FIG. 1, part of the ejected liquid is of course also received each time by the side walls 12. This liquid is reflected to a minor extent, whereas most of the rinsing liquid striking the side walls 12 drains off downwards along these walls. As is apparent from FIG. 1, the systematic use of the corner spray nozzles makes it possible to apply liquid systematically to the respective corner region 20, while simultaneously keeping overall water consumption low because the corner spray nozzles eject rinsing liquid only if this liquid can also reach those dishes placed in the baskets 23 in the corner regions 20.

Figure 2:
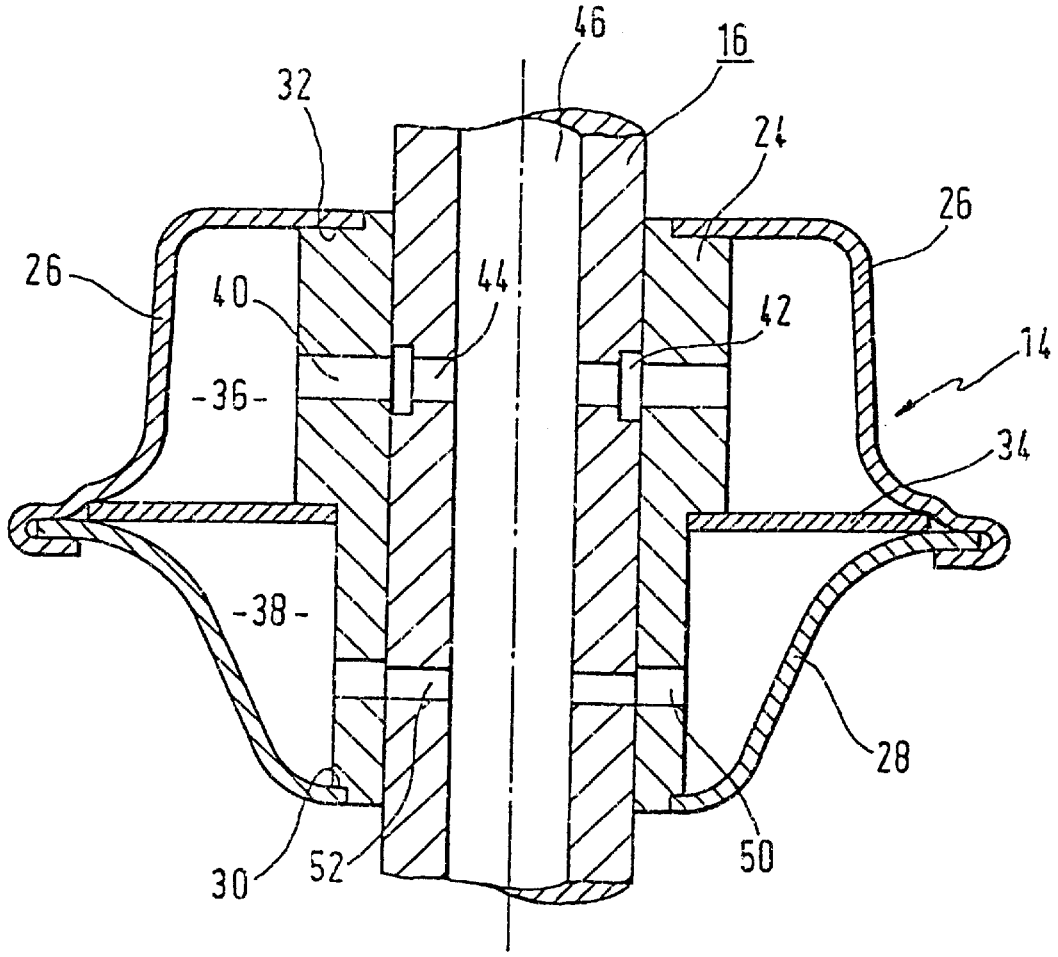
FIG. 2 shows section A—A in FIG. 1.

FIG. 2 illustrates a sectional view along line A—A in FIG. 1 and describes a possible design for the rinsing arm 14 and the flow connection to the axis 16 in order to accomplish, in technical terms, a systematic application of liquid to the corner spray nozzle just in the corner region each time.

The rinsing arm 14 comprises shaped members which are each attached to the hub 24. This particular exemplary embodiment depicts an upper member 26 made of sheet metal or plastic and a lower member 28 made of sheet metal or plastic. The lower member 28 engages with a first step 30 in the hub 24, while the upper member 26 is fitted into a step 32. The upper member is beaded around the lower member 28 in order to connect together the upper member 26 and the lower member 28. A hollow space which is divided by a partition plate 34 into two chambers is produced by the two members 26 and 28 by interaction with the hub 24. To simplify the following explanations, the chamber delimited by the upper member 26, partition plate 34 and hub 24 will be referred to as a first chamber 36, while the chamber formed by the lower member 28, partition plate 34 and hub 24 will be referred to as a second chamber 38. As is apparent by means of FIG. 3 below, the partition plate can only extend across part of the radial extension of the rinsing arm and in this way the members 26 and 28 may be shaped such as to delimit two separate chambers.

The hub 24 has an inner diameter dimensioned such that it can be fitted onto the axis 16 with minimum clearance. The axial fixation between the axis 16 and hub 24 in relation to one another is not depicted in FIG. 2 because any solution known to the skilled person may be used here. Axial fixation must be ensured within narrow tolerances so that, as will be described further below, the flow channels can ensure that the washing liquid passes out of the interior of the axis 16 formed as a hollow cylinder through into the first or second chamber of the rinsing arm.

Whereas too little clearance between the inner diameter of the hub and the outer diameter of the axis would impede the rinsing arm's free rotation around the axis, it is also necessary to avoid too large a clearance between these components in order that washing liquid is not able to emerge between these components to an undesirably high extent, which would reduce the desired pressure of the liquid in the outlet nozzles of the rinsing arm.

As is evident from FIG. 2, the hub 24 accommodates first bores 40 which produce a connection between an annular groove 42 on the outer periphery of the axis 16 and the first chamber 36. The annular groove 42 is connected by bores 44 to the inner flow space 46 of the axis 16 so that during operation of the washing liquid feed pump, the annular groove is always filled with liquid under pressure, this liquid being able to enter the first chamber 36 during the rotation of the rinsing arm 14.

FIG. 2 does not illustrate any outlet nozzles through which the rinsing liquid is ejected out of the first chamber 36 in the direction of the baskets. As shown by the illustration in FIG. 1, these outlet nozzles 48 may be radially spaced apart from one another on the rinsing arm 14 and may be adapted to the requirements of the respective dish washer in relation to its position and design which affects the geometry and intensity of the ejected liquid. It is also possible to arrange the outlet nozzles 48 on the rinsing arm 14 or to adapt their direction of ejection in such a way as to rotate the rinsing arm 14 around the axis 16 during operation of the liquid pump (not illustrated) as a result of the repulsion action of the liquid emerging from the outlet nozzles.

Once more with reference to FIG. 2, the hub 24 accommodates second bores 50 which in the depicted sectional illustration are in alignment with corresponding bores 52 in the axis 16. Unlike the flow connection between the axis and the first chamber 36, the flow connection between the inner flow space 46 of the axis 16 and the second chamber 38 is designed such that the washing liquid can only flow into the second chamber 38 when the rinsing arm 14 is located in a diagonal position as shown in FIG. 1.

For this purpose, four bores 52 are provided in the axis 16 fixedly disposed in the dish washer such that the four second bores 50 match only in one rotary position or the rinsing arm in accordance with the position shown in FIG. 1 and in each case rotated by 90° thereto.

This results in the fact that the pressurized rinsing liquid is each time fed into the second chamber 38 only within a small angular range during the rotation of the rinsing arm 14 around the axis 16 and that the liquid can correspondingly emerge out of the corner spray nozzles 22 which represent the flow connection between the second chamber 38 and the interior of the dish washer.

Whereas in the exemplary embodiment according to FIGS. 1 and 2, the second bores 50 are shown precisely in the diagonal position of the rinsing arm in accordance with the bores 52, a small angular offset can also be systematically provided in accordance with the rinsing arm's direction of rotation within the dish washer in order to take account of that interval of time during the rinsing arm's rotation which is needed so that the pressure pulse of rinsing liquid is built up inside the second chamber 38 and is continued in a radially outward manner as far as the corner spray nozzles 22.

Figure 3:
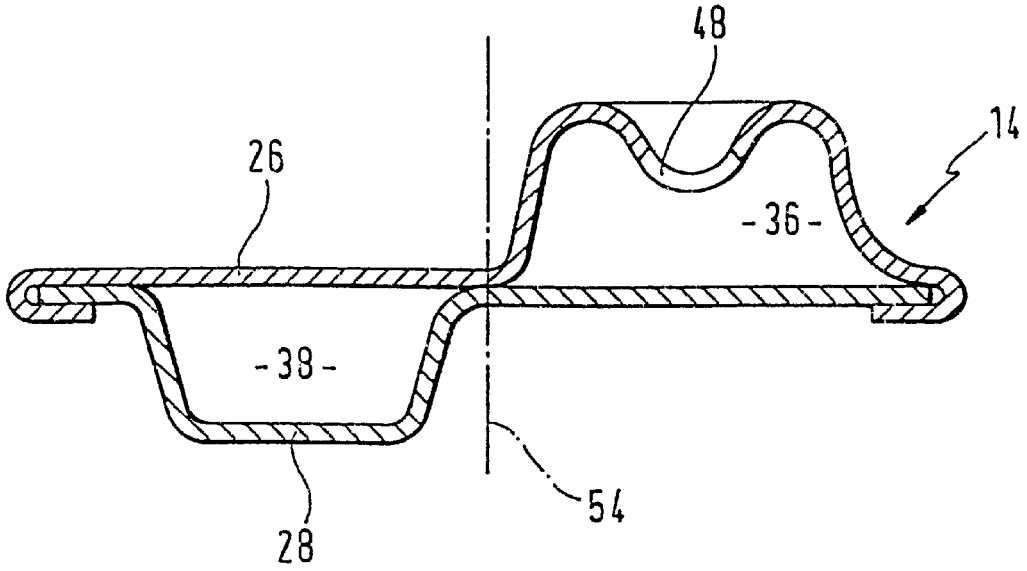
FIG. 3 shows section B—B in FIG. 1.
Figure 4:
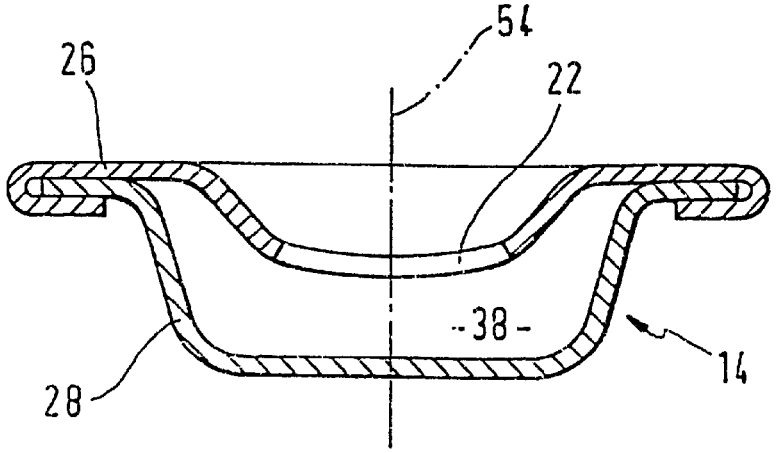
FIG. 4 shows section C—C in FIG. 1.

FIGS. 3 and 4 each show the sections along lines B—B and C—C indicated in FIG. 1. As is apparent from the figures, the region of the sections B—B and C—C no longer contains any partition plate between the upper member 26 made of sheet metal or plastic and the corresponding lower member 28 made of sheet metal or plastic. Whereas the first chamber 36 and the second chamber 38 are offset in relation to the longitudinal axis 54 of the rinsing arm 14 in the area of the sectional illustration B—B shown in FIG. 3, and whereas the upper member 26 and lower member 28 make close contact with one another in the area of the axis 54 so as to prevent a flow connection between the first chamber 36 and the second chamber 38, only the second chamber 38, which produces the flow connection to the corner spray nozzle 22, is formed in the area of the sectional illustration C—C. Of course, the respective design of the geometry of the rinsing arm 14 is shown in FIGS. 2, 3 and 4 only by way of example; the essential aspect lies in the fact that two separate chambers 36 and 38 are provided and that the second chamber 38 envisages the connection to the corner spray nozzles 22.

As was already explained in conjunction with FIG. 1, the corner spray nozzles 22 are shaped such that the jet of rinsing liquid is issued not only in a vertical direction, but also at an angle in a radially outward manner in order to reach the corner regions 20 (see FIG. 1). In the same way, the outlet nozzles 48, which are operated independently of the rinsing arm's rotary position, can be adapted to the needs for effective cleaning within the dish washer and to a low water consumption. It might be expedient to design the outlet nozzles 48*a,* which are externally mounted to the radially furthest extent, such that the rinsing liquid is issued not only in a vertical direction, but also at an angle in a radially inward manner. This avoids unnecessary loss of water which is caused by the fact that the rinsing liquid strikes the side walls 12 and drains off unused along the side walls.

What is claimed is:

1. A washing device or rinsing device for a dish washer comprising a washing arm or rinsing arm (14);

an axis (16) rotatably supporting said washing arm or rinsing arm (14);

said washing arm or rinsing arm (14) having a first chamber (36) and a second chamber (38) separate from said first chamber;

said first chamber (36) and said second chamber (38) each having at least one inlet aperture (40, 50) and at least one outlet aperture (48, 48*a,* 22) for washing liquid or rinsing liquid;

wherein said at least one outlet aperture (22) of said second chamber (38) is designed as a corner spray nozzle (22) and liquid can be applied thereto only in defined rotary positions of said washing arm or rinsing arm (14) on said axis (16);

wherein said axis (16) comprises a single flow space (46) for washing liquid or rinsing fluid;

wherein said washing arm or rinsing arm (14) comprises a hub (24) attachable to said axis (16) and supporting said washing arm or rinsing arm (14);

wherein said axis has bores (52) which are in flow communication with said inner flow space (46) of said axis and, in defined rotary positions, with bores (50) in said hub; and further comprising flow passages (40) in said hub (24) which are in flow communication with said first chamber (36) and in flow communication with said inner flow space (46) of said axis (16) irrespective of the rotary position of said hub (24) in relation to said axis (16).

2. A washing device or rinsing device for a dish washer comprising a washing arm or rinsing arm (14); and an axis (16) rotatably supporting said washing arm or rinsing arm (14);

said washing arm or rinsing arm (14) having a first chamber (36) and a second chamber (38) separate from said first chamber; and said first chamber (36) and said second chamber (38) each having at least one inlet aperture (40, 50) and at least one outlet aperture (48, 48*a,* 22) for washing liquid or rinsing liquid; wherein said at least one outlet aperture (22) of said second chamber (38) is designed as a corner spray nozzle (22) and liquid can be applied thereto only in defined rotary positions of said washing arm or rinsing arm (14) on said axis (16);

said washing arm or rinsing arm (14) comprises two shaped members (26, 28) which are each secured to said hub (24) and to one another and hold a partition plate (34) dividing the hollow space formed between said shaped members (26, 28) into said first chamber (36) and said second chamber (38).

3. A washing device or rinsing device according to claim 2, wherein said axis (16) comprises a single flow space (46) for washing liquid or rinsing liquid.

4. A washing device or rinsing device according to claim 3, wherein said washing arm or rinsing arm (14) comprises a hub (24) attachable to said axis (16) and supporting said rinsing arm (14); and said axis has bores (52) which are in flow communication with said inner flow space (46) of said axis and, in defined rotary positions, with bores (50) in said hub.

5. A washing device or rinsing device according to claim 4, further comprising flow passages (40) in said hub (24) which are in flow communication with said first chamber (36) and in flow communication with said inner flow space (46) of said axis (16) irrespective of the rotary position of said hub (24) in relation to said axis (16).

6. A washing device or rinsing device for a dish washer comprising a washing arm or rinsing arm (14);

an axis (16) rotatably supporting said rinsing arm (14);

said washing arm or rinsing arm (14) having a first chamber (36) and a second chamber (38) separate from said first chamber;

said first chamber (36) and said second chamber (38) each having at least one inlet aperture (40, 50) and at least one outlet aperture **(48, 48*a*, 22)** for washing liquid or rinsing liquid;

wherein said at least one outlet aperture (22) of said second chamber (38) is designed as a corner spray nozzle (22) and liquid can be applied thereto only in defined rotary positions of said washing arm or rinsing arm (14) on said axis (16);

wherein said at least one outlet aperture **(48*a*) of said first chamber (36) of said washing arm or rinsing arm (14) which is furthest removed from said hub (24)** is designed such as to issue washing liquid or rinsing liquid at an angle in a radially inward manner;

wherein said axis (16) comprises a single flow space (46) for washing liquid;

wherein said washing arm or rinsing arm (14) comprises a hub (24) attachable to said axis (16) and supporting said washing arm or rinsing arm (14);

wherein said axis has bores (52) which are in flow communication with said inner flow space (46) of said axis and, in defined rotary positions, with bores (50) in said hub; and further comprising flow passages (40) in said hub (24) which are in flow communication with said first chamber (36) and in flow communication with said inner flow space (46) of said axis (16) irrespective of the rotary position of said hub (24) in relation to said axis (16).

* * * * *